United States Patent [19]

Valts et al.

[11] Patent Number: 4,899,502

[45] Date of Patent: Feb. 13, 1990

[54] BUILDING OR STRUCTURE ERECTED ON A SLOPE

[75] Inventors: Semen P. Valts; Viktor A. Golovko; Alexei N. Stepanenko, all of Yalta; Alexandr N. Tetior, Simferopol; Karim P. Fen, Yalta; Alexandr M. Lekhno; Boris J. Barykin, both of Simferopol; Vitaly L. Altunin; Valentin V. Pekarsky, both of Yalta; Georgy K. Meleshko, Evpatoria, all of U.S.S.R.

[73] Assignee: Golovnoi Nauchno-Issledovatelsky i Proektny Institut "KrymNIIproekt" Simferopolsky Filtal Dnepropetrovskogo Inzhenernostroitelnogo Instituta, Simferopol, U.S.S.R.

[21] Appl. No.: 51,461

[22] PCT Filed: Jul. 4, 1986

[86] PCT No.: PCT/SU86/00068

§ 371 Date: Mar. 4, 1987

§ 102(e) Date: Mar. 4, 1987

[87] PCT Pub. No.: WO87/00229

PCT Pub. Date: Jan. 15, 1987

[51] Int. Cl.[4] ..... F02D 27/02

[52] U.S. Cl. ..... 52/169.4; 52/169.2

[58] Field of Search ..... 52/167, 169.4, 169.1, 52/169.2, 169.3

[56] References Cited

U.S. PATENT DOCUMENTS

| | | | |
|---|---|---|---|
| 1,706,496 | 3/1929 | Pieri | 52/167 X |
| 2,241,830 | 5/1941 | Tourtellotte | 52/169.4 |
| 3,269,125 | 8/1966 | Moore | 52/169.4 |
| 3,724,147 | 4/1973 | Levenson | 52/169.4 X |
| 3,913,285 | 10/1975 | Helfrich | 52/169.4 X |
| 3,932,970 | 1/1976 | Winders et al. | 52/169.4 X |
| 3,942,291 | 3/1976 | Hirataz et al. | 52/169.4 |
| 4,125,970 | 11/1978 | Vidal | 52/169.4 X |
| 4,141,184 | 2/1979 | Vidal | 52/169.4 |

FOREIGN PATENT DOCUMENTS

| | | | |
|---|---|---|---|
| 3022029 | 12/1981 | Fed. Rep. of Germany | 52/169.4 |
| 250417 | 10/1970 | U.S.S.R. . | |
| 553334 | 4/1977 | U.S.S.R. . | |
| 949078 | 8/1982 | U.S.S.R. . | |

OTHER PUBLICATIONS

All-Union Publishing-Printing Corporation, Means of Communication Ministry, M. 1960, pp. 54 and 55.

*Primary Examiner*—Michael Safavi

*Attorney, Agent, or Firm*—Fleit, Jacobson, Cohn, Price, Holman & Stern

[57] ABSTRACT

A building according to the instant invention comprises a frame of vertical and horizontal components which is connected to a foundation located along the generatrix of a slope surface. The foundation is provided with a device receiving the sloping component of the external loads of the frame and the foundation which is directed along the generatrix of the slope surface.

8 Claims, 7 Drawing Sheets

BUILDING OR STRUCTURE ERECTED ON A SLOPE

TECHNICAL FIELD

The invention relates to building operations, namely, to a building or structure erected on a slope.

A most effective field of the herein-disclosed invention is the development of unused or partially used areas to date such as steep slopes at foothills, hills, ranges, ravines, hollows, the banks of rivers, lakes, the shores of seas and oceans. In these areas there may be built recreational facilities, such as sanatoria, rest-homes, holiday hotels, motels, tourist, mountain-skiing and mountain-climbing bases of terrace and terrace-cascade type, dwelling houses of a terrace, terrace-cascade and structural types and other structures of various designation.

The massifs of slopes normally comprise ground beddings heterogeneous by physico-mechanical properties and featuring complex geological and hydro-geological conditions facilitating the activization of soil creep phenomena.

The foregoing conditions are dramatically aggravated in seismic-prone zones, where the utilization of the herein-disclosed invention is especially rational.

The general indicator of development of such areas is a drastic rise in construction costs compared with those on a flat terrain while using traditional structures and existing building methods because of the absence of special building structures and foundations to be erected on steep slopes.

At the same time, in mountainous regions and foothills the areas with a flat terrain are becoming scarce. The lands of these regions and areas are primarily to be used for farming and man's economic activity with observation of the requirements of environmental protection as well as with an eye to solving recreation problems.

The trends of urban development objectively show that an improvement in architectural lay-out and functional properties of buildings with the aim of providing man's natural environment against the backdrop of complex relief may be attained due to the changeover from constructing tall buildings to erecting mostly terrace and terrace-cascade type buildings.

BACKGROUND OF THE INVENTION

Construction of buildings in areas with a steep relief of the terrain using the existing construction technique involves reforming of the terrain natural landscape because of the necessity of building artificial terraces by undercutting the slope soil with subsequent erection of special slope-holding structures in the form of relieving walls and similar constructions.

The foundation and the building frame made up of vertical and horizontal discs are erected on the thus prepared slope base.

The vertical force from loads of the building is resolved into sloping and normal components. Shear strain grows in the mass of the slope-base due to the sloping component of the load from the building being erected which is directed parallel to the slope generatrix. The relationship between the contour line and the vertical of the terrace depends upon the physico-mechanical characteristics of the slope soils.

Known in the art is the foundation of a building or structure erected on a rocky base; besides, in case of rocky beddings of the slope mass due account is taken of the bed's orientation relative to the dip of the relief. Given non-rock soils of the slope, the slope gradient is most often decreased with the aim of ensuring the stability of the slope-building system, which is associated with a greater volume of earth-moving operations.

The foregoing specifics of the development of slopes complicate the application of industrial methods of building operations.

As was noted above, the greater part of the areas with a steep relief of terrain is located in seismic-prone zones, where the utilization of rational structures of terrace or terrace-cascade type of buildings is limited or ruled out because of unsatisfactory dynamic characteristics of the building structures and eventually low operational reliability of the existing buildings, structures under seismic effects. The stiffness of buildings is usually increased by introducing special vertical structures in the frame which are shaped as diaphragms, bracings and stiffness cores and normally saturated with costly reinforcing steel.

USSR Inventor's Certificate No. 553334, IPC E 02 D 27/34 teaches the construction of the foundation of a cascade-type building or structure erected on the slopes of rocky massifs in seismic-prone zones.

The slope is prepared for the foundation in a broken line by virtue of ascending, horizontal and descending undercuts of the slope.

The foundation is made in the form of a reinforced concrete slab copying the shape of an undercut slope. In order to ensure stability to seismic effects, the foundation is provided with vertical longitudinal and transverse ribs, with bearing shoes being mounted under the supporting constructions of the prefabricated reinforced concrete frame of the building and arranged in the place of intersection of these ribs. The building frame contains vertical and horizontal thin, elongated structural components.

Disadvantages of the aforementioned solution are the undercutting of the slope base down to bedrocks, development of the base soil of a complex broken configuration, high labour intensity and costs of the foundation erection and low reliability during seismic effects which does not rule out the slipping down of the entire massif, particularly if the beds are parallel to the slope.

Besides, the application of this solution is confined mostly to the slopes of rocky massifs due to the transition of substantial shear stress from the sloping component of the building load to the slope. In areas with steep slopes and extremely rolling terrain, namely, slopes with the soils having low physico-mechanical properties (the angle of internal friction, adhesion or bond, consistency, stress-strain modulus) ravines, hills, dumping ground, it is impossible to use this technique because of an insufficient bearing capacity of soils in the slopes, particularly in seismic-prone zones.

It is a specific object of the invention to construct a building or structure erected on slopes whose design would make it possible to rule out the impact of the sloping component of external loads of the frame and foundation on the slope soil.

SUMMARY OF THE INVENTION

Said object is accomplished due to the fact that in the building or structure erected on a slope, comprising the frame of vertical and horizontal structural components and connections with the foundations. According to the invention, the foundation is arranged along the generatrix of the slope surface and is provided with a means receiving the sloping component of the external loads of the frame and foundation directed along the generatrix of the slope surface. The availability of the herein-disclosed means enables one to use the slope with any soil as the foundation base. At the same time, the base is not subjected to a shear stress from external loads because the sloping component of the vertical load from the building weight is transmitted via the foundation to this means rather than to the base. As a result, it is only the normal stress component that is transmitted to the slope that permits a slope of any gradient to be used without preliminary decrease in its curviture regardless of physico-mechanical properties of its soil to make the maximum use of the compressive strength characteristics of the slope soil.

In the preferred embodiment of the invention the foundation base is arranged along the generatrix of the slope surface.

The arrangement of the bearing surface of the foundation along the generatrix of the slope surface rules out the undercutting of the slope for the foundation, makes it possible to reduce to a minimum the volume of earth-moving operations (only the lay-out is made parallel to the slope with the removal of top soil), and enables one to mechanize earth-moving works and use prefabricated constructions of the foundations.

It is expedient that the foundation be connected to the frame by means of the latter's structural components.

This connection of the foundation to the building frame helps improve dynamic characteristics of the building or structure of a terrace, cascade, or terrace-cascade type erected in seismic-prone zones. The building or structure reliably receives horizontal loads during seismic activity due to the three-faceted prisms formed by the frame and the foundation. This makes it possible to appreciably diminish the consumption of resources when developing the areas with steep terrain in seismic-prone zones because the stiffness of a building or structure is increased by transmitting the horizontal component of the seismic load via the horizontal structural elements to the foundation.

According to one of the embodiments of the invention the means receiving the sloping component of external loads of the frame and the foundation is arranged beyond the latter in the lower portion of the slope and is secured in the lower beds of its soil.

Given such an arrangement of the means, there is attained a most complete use of the strength properties of stronger soils lying in the lower part of the slope mass compared with the foundation base soils. The slope stability in this case is improved owing to a pressing action of the normal component of the building weight.

In another embodiment of the invention the means receiving the sloping component of the external loads of the frame and foundation is arranged beyond the foundation in the upper part of the slope and is secured in the lower beds of its soil.

Given such an arrangement of the means, there is achieved a most complete utilization of the strength properties of stronger soils than under the foundation, e.g., rocky grounds lying in the upper part of the slope mass.

In still another embodiment of the invention the foundation is made in the form of a reinforced concrete grate of longitudinal and cross strips arranged on the opposite slopes of a ravine. The connection of the lower ends of the cross strips serves as a means receiving the sloping components of the external loads from the frame and the foundation directed along the generatrices of the surfaces of the slopes. In this structural embodiment of the invention the building stability is achieved due to a mutual balancing of the sloping components of the building weight affecting the cross strips in the place of connection thereof.

In keeping with one of the embodiments of the invention the foundation is made as a reinforced concrete grate of longitudinal and cross strips arranged on the opposite slopes of a ravine; the horizontal structural components of the frame rigidly link the cross strips to each other to serve as the means receiving the sloping components of the external loads from the frame and the foundation. In this embodiment of the invention, building stability is ensured due to the fact that the horizontal structural elements of the frame receive the sloping components of the loads from the building. Meanwhile, under the action of the pressure from the strips an additional compressive force is created in the horizontal structural elements owing to which the consumption of reinforcing steel used to manufacture horizontal structural elements may be reduced. In case there is soft ground in the bottom of the ravine, and in order to let water pass through the ravine, the building's constructions are mounted a respective distance above the ravine bottom.

When erecting a building or structure on a mountain or hill, the foundation may be made in the form of a reinforced concrete grate made up of longitudinal and cross strips arranged on the opposite slopes of the mountain or hill, and the connection between the upper ends of the cross strips serve as the means receiving the sloping components of the external loads of the frame and the foundation. In this embodiment of the invention the stability of the building is attained due to a tensile equilibrant forces in the place of connection of the foundation strips which experience tension from the sloping component of the external loads of the frame or foundation.

It is fairly expedient that a connection between the horizontal structural elements of the frame and the foundation, as well as between the foundation strips, be made as a hinged joint.

The hinged joint permits the section of the structural elements and foundation strips to be decreased in the place of connection thereof due to a substantial decline in the bending moment in these joints.

According to one of the structural embodiments of the invention the foundation is connected to the frame with the aid of the latter's structural elements. The foundation is made in the form of a reinforced concrete grate-truss comprising longitudinal, cross and diagonal strips.

This embodiment of the invention makes it possible to erect a building or installation of a structural type on steep slopes which is compact in a plan view and forms internal spaces free from building development. With such an embodiment of the invention functional and architectural lay-out qualities of buildings under construction are improved. Pedestrian crossings, passages for motor vehicles, such as fire-fight and ambulance vehicles, etc. can thus be provided. Besides, the volume of earth-moving work is decreased, the natural landscape is preserved inside the development area and an organic link is effected with the external relief of the terrain.

The making of the foundation in the form of a reinforced concrete grate from longitudinal and cross strips arranged on the slope of a hill, whereby a closed ring embracing the hill and connected to the cross strips of the foundation serves as a means receiving the sloping component of the external loads of the frame and foundation directed along the generatrix of the slope surface, makes it possible to ensure the stability of a building or structure being erected. The foundation structure embracing the hill permits buildings to be erected at any sector along the length of the hill. It is also possible to develop the hill in a fragmentary manner or pattern erecting buildings of a structural, cascade, terrace and other types. In one of the structural embodiments of the invention a ring serves as the the means receiving the sloping component of the external loads of the frame and foundation directed along the generatrix of the hill surface.

The use of anchors connected to the foundation and secured in the lower beds of soils makes it possible, in case there are no primary or strong rocks at the base and the top of a hill, to make use of deeper lying primary rocks in the slope to transmit the sloping component of the load thereto, decrease the material intensity of the cross foundation slabs by way of reducing bending moments therein.

BRIEF DESCRIPTION OF DRAWINGS

Other objects and advantages of the present invention will be more apparent from the following detailed description of the exemplary embodiments thereof, reference being made to the accompanying drawings, wherein.

BEST MODE FOR CARRYING OUT THE INVENTION

Figure 1:
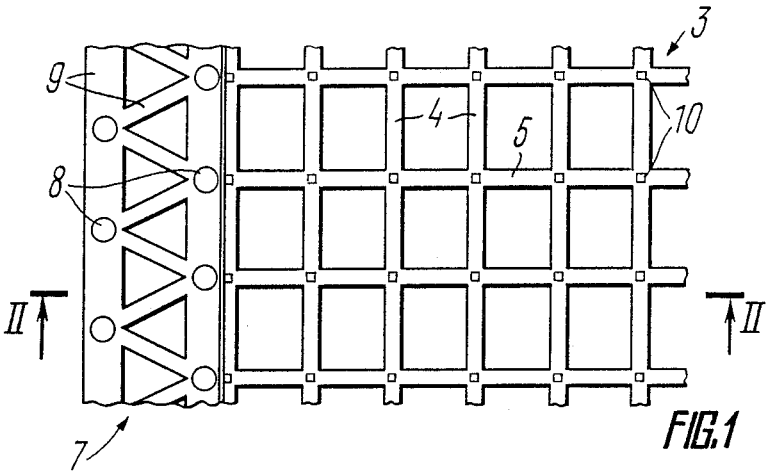
FIG. 1 is a plan view of the foundation of a building structure of a terrace type, erected on a slope.
Figure 2:
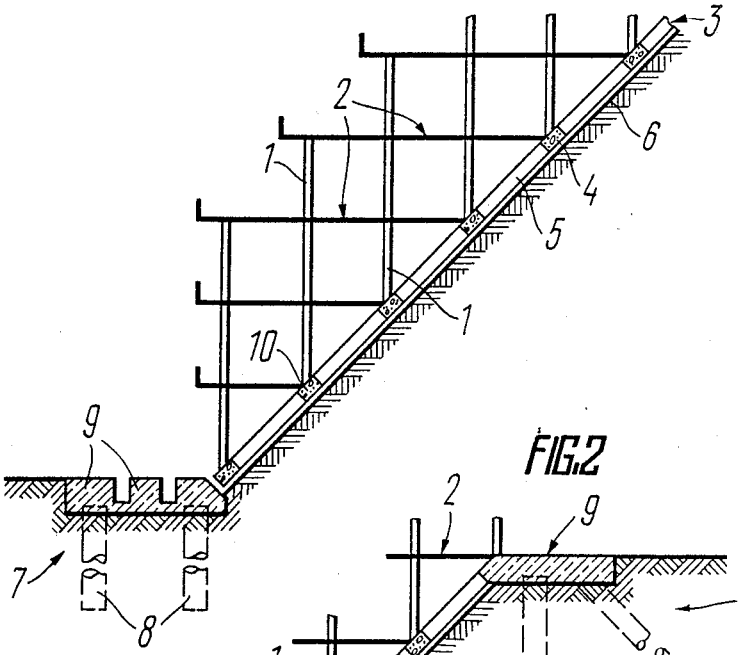
FIG. 2 is section II—II of FIG. 1.
Figure 3:
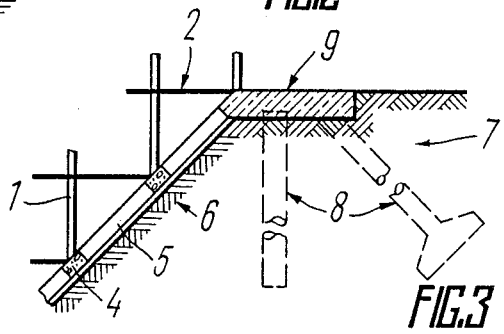
FIG. 3 is a view of a variant of the arrangement of the means receiving the sloping component of the external loads of the frame and foundation.

The terrace-type building comprises a frame from vertical structural elements 1 (FIGS. 1–3) and horizontal structural elements 2, foundation 3 in the form of a reinforced concrete grate from longitudinal strips 4 and cross strips 5 with a concrete base 6 for levelling off the soil and a means 7 receiving the sloping component of the external loads of the frame and foundation 3 directed along the generatrix of the slope. The design of the means 7 is chosen depending on the properties of the slope's soil, the place of arrangement of a building on the slope, the slope relief and may be made, e.g., in the form of piles 8 and grillage 9. The horizontal elements 2 of the building frame are secured to the longitudinal strips 4 of the reinforced concrete foundation 3. The base of the foundation 3 is arranged along the generatrix of the slope surface and may be flat, ribbed or have any other shape. FIGS. 2, 3 show the variants of arrangement of the means 7 in the lower and upper parts of the slope.

The reinforced concrete foundation 3 rests against the grillage 9 by the lower end of the cross strip 5.

The building structures of a terrace type are erected as follows. At first, top soil of the slope is removed and the latter is laid out. Thereupon, the piles 8 and grillage 9 are installed. Once the concrete of the piles 8 and grillage 9 has reached the design strength, the longitudinal strips 4 and cross strips 5 of the foundation 3 are mounted. Column footings 10 are installed in the place of the intersection of the strips 4 and 5.

Thereafter, the building frame structures are erected, namely, the vertical elements 1 and horizontal elements 2, the vertical elements 1 are connected to the column footings 10 and the horizontal elements 2 are connected to the longitudinal strips 4. The external load from the building is transmitted to the slope by means of the foundation 3. The vertical load P (FIG. 4) from the building weight is resolved into two components $P_N$ and $P_W$, one of which $P_W$ is directed along the generatrix of the slope surface, and the other, $P_N$, is directed normally to the surface thereof.

The sloping component $P_W$ of the vertical force of the frame and foundation 3 is transmitted via the cross strips 5 of the foundation 3 to the bearing surface of the grillage 9 and pile 8, and the component directed normally to the slope surface is received by the soil mass of the slope.

Figure 4:
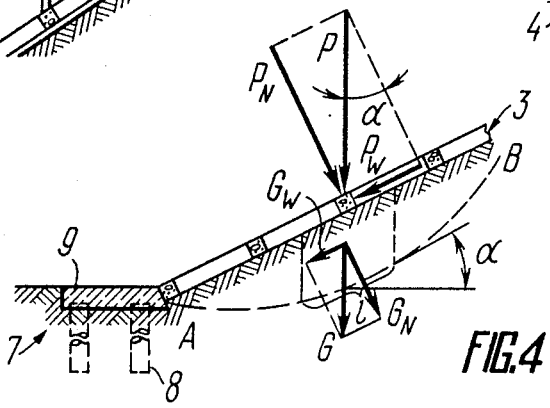
FIG. 4 is a diagram of the action of forces from the vertical loads of a building and the weight of soil on the slip plane in the slope soil.

The following symbols are used in FIG. 4:

P is the vertical load from the building to sector 1 of the slip plane A–B in the slope soil;

G is the same from the inherent weight of the soil located above sector 1;

$P_N$, $G_N$ are normal components of the loads from the building and soil weight above sector 1, respectively;

$P_W$, $G_W$ are the same, sloping components;

$\phi$ is the angle of internal friction of the slope soil, in degrees;

C is the bond of slope soil;

W is shearing force;

N is holding force.

It is clear from the given diagram that, all things being equal, shearing forces from the building loads do not affect the sector of the slope soil under consideration, given the building design according to the present invention; therefore, the slope sector stability factor is higher than for the same sector with the traditional design of the foundation of the building erected on a slope.

Besides, after the erection of the herein-disclosed building the stability factor of the slope grows compared with the value of the stability factor prior to the erection of a building thereupon.

During seismic effects the building structures receive vertical forces in the manner analogous to that described hereinabove. Horizontal forces are received by a system of spatial figures shaped as three-faceted prisms formed by the building structures as vertical structural component 1 and horizontal structural component 2 of the frame and longitudinal and cross strips 4 and 5 of the foundation 3.

If the means 7 of piles 8 and grillage 9 is arranged in the upper part of the slope (cf. FIG. 3) the construction work on the slope is begun from the top portion of the slope: once the piles 8 and grillage 9 have been constructed, cross strips 5 are secured to said grillage 9 and are grouted with the longitudinal strips 4 of the foundation 3. Thereupon, the building or structure is erected in the manner analogous to the one described hereinabove. The sloping component of the vertical forces of the frame and foundation 3 is transmitted via the cross strips 5 of the foundation 3 to the grillage 9 and piles 8, and the component $P_N$, directed normally to the slope surface, is received by the soil mass of the slope.

Thus, the structural features of a terrace-type building erected on a slope help proceed from a stressed state of shear in the slope soil to a stressed state of compression in the soil of the slope mass which makes it possible to use the slope of any gradient with any soils for construction work and make an effective use of the strength properties of the slope soil.

It is more expedient that the means 7 be made in soils with higher physico-mechanical properties compared with those of the soils under the foundation 3; therefore, the selection of the place of arrangement thereof—in the bottom or at the top of the slope—is associated with the place of location of these soils. In case soils are available which have similar physico-mechanical properties in the lower and upper parts of the slope, it is more expedient that the means 7 be arranged in the lower part of the slope, because in this case the foundation strips 5 transmitting the sloping component $P_W$ of building loads to the means 7 will experience compression. This is preferable for the material of the strips 5, namely, reinforced concrete, than tension arising in the strips 5 when the means 7 is disposed in the upper part of the slope.

If a building is erected in a ravine or hollow, it consists of a frame comprising vertical (FIGS. 5, 6) and horizontal structural components 1 and 2, respectively, and the foundation 3 in the form of a reinforced concrete grate of longitudinal 4 and cross 5 strips arranged on the opposite slopes of the ravine or hollow. The lower ends of the strips 5 are connected to each other at the bottom of the ravine or hollow. This connection serves as the means 7 receiving the sloping components of the loads from the frame and the foundation 3 directed along the guides of the planes of the ravine slopes.

The building is erected in the following order: first, the ravine slopes are laid out and the strips 4,5 are placed on the ravine slopes in the lower part thereof. The strips 5 are simultaneously linked to each other in the bottom of the ravine. Thereafter, the vertical 1 and horizontal 2 components of the building frame are mounted. The connection of the strips 5 of the foundation 3 to each other may be a hinged or rigid joint depending upon specific structural features of the building.

If necessary, the building structures are dismantled in the order reverse to that of erection which makes it possible to dismantle the building without modifying the natural structure of the terrain landscape.

The external load from the building weight is transmitted by means of the bearing strips 4,5 of the foundation 3 to the soil of the ravine slopes. The vertical force from the building or structure weight is resolved into two pairs of components, one of which is directed along the generatrices of the planes of the ravine slopes, and the other normally to these surfaces. The sloping components are mutually balanced through the connection of the lower ends of the strips 5 of the foundation 3. The components, normal to the slope surface, are received by the ravine slopes. The ravine slopes under the building or structure are in a partially closed space which enables one to make maximum effective use of the soil strength characteristics.

Figure 7:
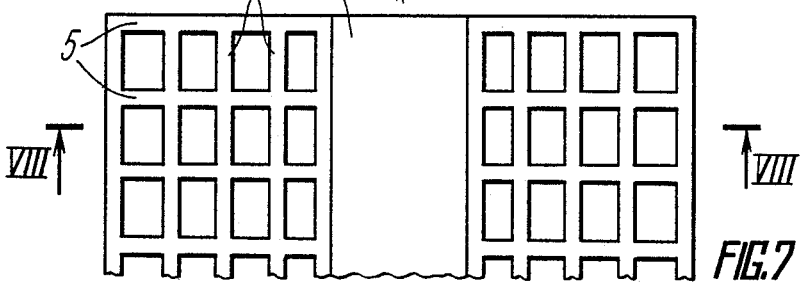
FIG. 7 is a plan view of a variant of the arrangement of a building or structure on the opposite slopes of a ravine.
Figure 8:
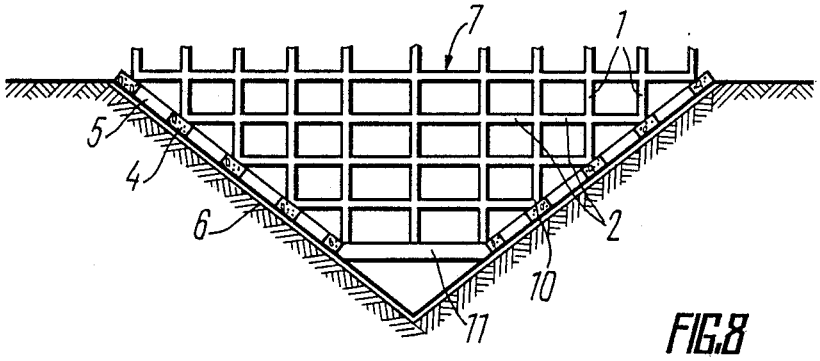
FIG. 8 is a view along section VIII—VIII of FIG. 7.

FIGS. 7,8 show a variant of the erection of a building in a ravine.

The building consists of an overfoundation structure, comprising vertical 1 and horizontal 2 structural components and the foundation 3 in the form of a reinforced concrete grate of longitudinal 4 and cross 5 strips placed on the opposite slopes of the ravine. The lower ends of the cross strips 5 are connected by a compressed distance-piece 11 at a prescribed height from the ravine bottom. The longitudinal strips 4 of the foundation 3 on the opposite slopes of the ravine are connected by means of the horizontal components 2 of the frame. The components 2 serve as the means 7 receiving the sloping components of the external loads of the frame and foundation 3. The connection of the strips 5 to each other and components 2 to the strips 4 may be a hinged or rigid joint, depending on specific structural features of the building. The connection of the strips 5 of the foundation 3 to the components 2 of the frame helps reduce material intensity of the building structures due to a more rational distribution of forces in the structures, particularly in the components 2 of the floors.

Figure 5:
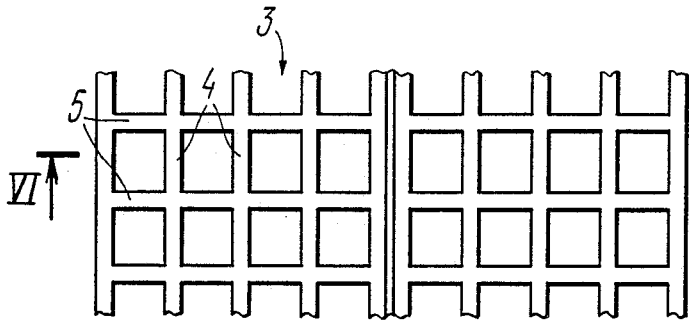
FIG. 5 is a plan view of a variant of the arrangement of a building or structure on the opposite slopes of a ravine.
Figure 6:
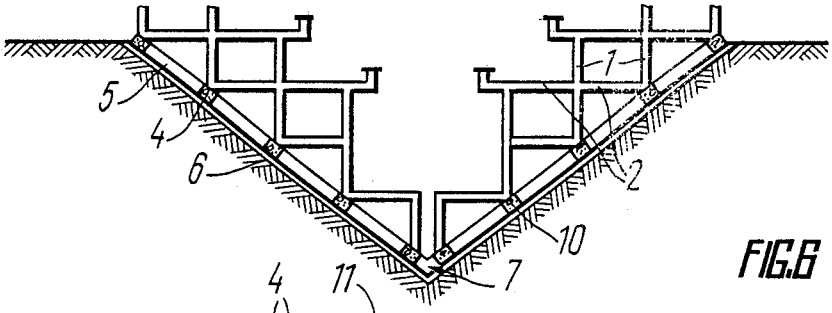
FIG. 6 is a view along section VI—VI of FIG. 5.

The structures are erected in the manner analogous to that described for an exemplary embodiment of the invention shown in FIGS. 5 and 6.

Figure 9:
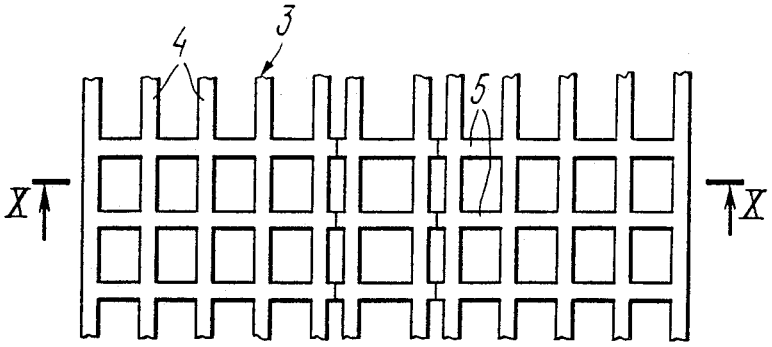
FIG. 9 is a plan view of the foundation of a building or structure arranged on top of a mountain or hill.
Figure 10:
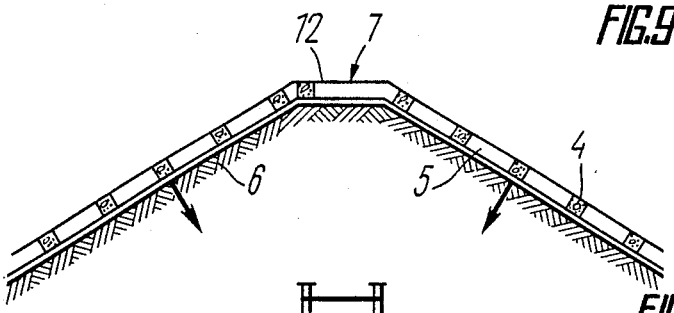
FIG. 10 is a view along section IX—IX of FIG. 9.
Figure 11:
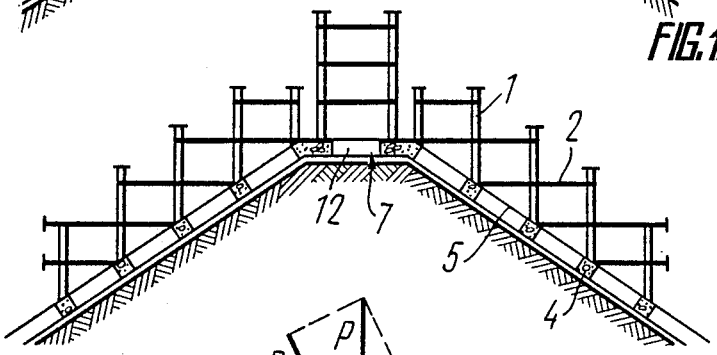
FIG. 11 is a view of the structural arrangement of a terrace-type building on the slopes of a hill or mountain.

FIGS. 9,10,11 show a variant of a building erected on a mountain or hill.

The foundation 3 of the building is made in the form of a reinforced concrete grate made up of longitudinal 4 and cross 5 strips arranged on the opposite slopes of the mountain. The upper ends of the strips 5 are connected to each other at the top of the mountain or hill by means of a strip 12 serving as the means 7 receiving the sloping components of the external loads from the frame or foundation 3.

The building structures are erected as follows: first, the slopes and the mountain top are laid out and the bearing strips 4,5 of the foundation 3 are mounted on the opposite slopes of the hill or mountain from top to bottom with a simultaneous connection of the upper ends of the strips 5 by means of the strip 12 at the mountain top. Thereafter, the overfoundation structures of vertical 1 and horizontal 2 discs of the building are erected. The external load from the building is transmitted to the mountain slopes by the bearing strips 4,5 of the foundation 3. The vertical forces from the building or structure weight are resolved into two pairs of components, one of and is directed along the slopes, while the other normally to the surface thereof. The sloping components of the building weight are mutually balanced in the strip 12. The components directed normally to the surface of the slopes transmit the compressive load to the slope soil, increasing its stability.

The mountain as a whole or partially is located in a closed space (three-axial compression) which makes it possible to effectively use the strength characteristics of the soil on the slopes of a hill or mountain.

Figure 12:
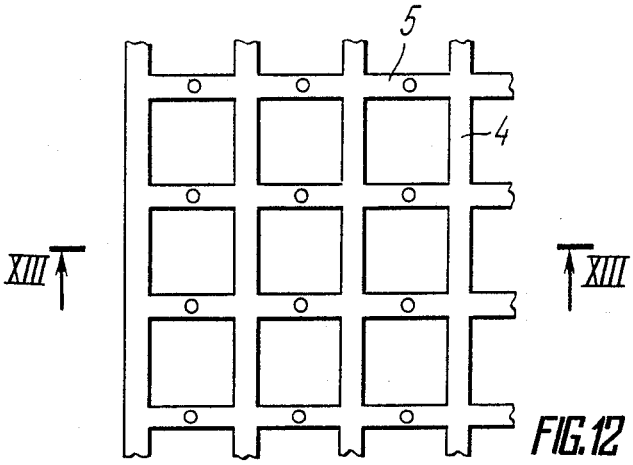
FIG. 12 is a plan view of a building structure erected on a slope.
Figure 13:
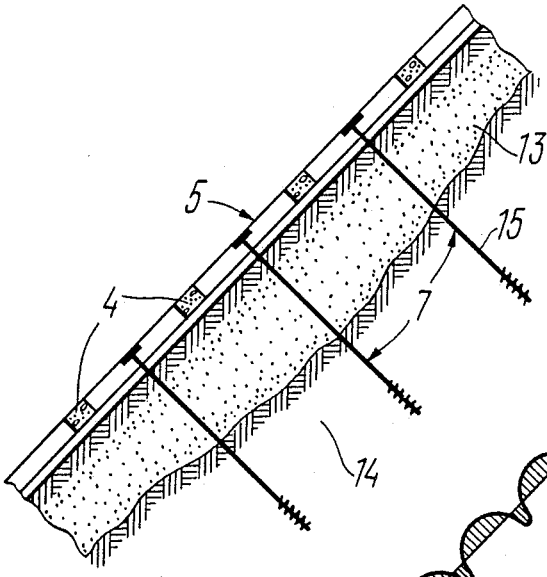
FIG. 13 is a view along section XIII—XIII of FIG. 12.
Figure 14:
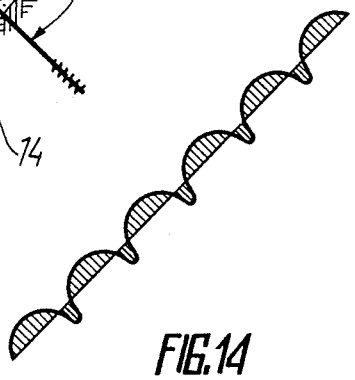
FIG. 14 is a representation of bending moments in the cross foundation strips.
Figure 16:
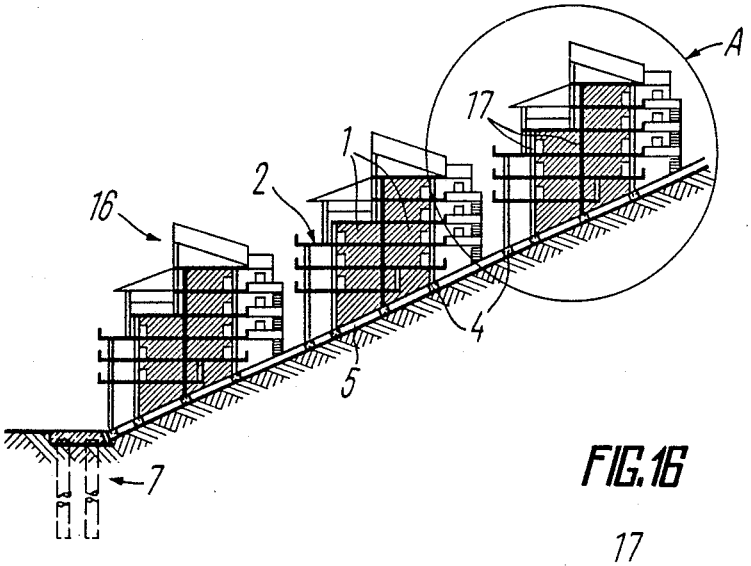
FIG. 16 is a view along section XVI—XVI of FIG. 15.
Figure 15:
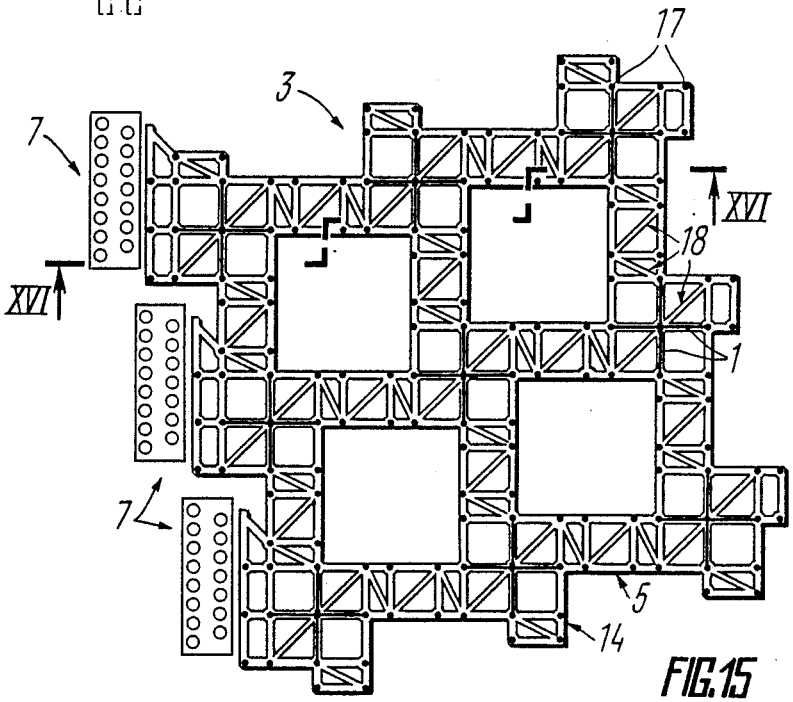
FIG. 15 is a plan view of a building structure erected on a slope.
Figure 18:
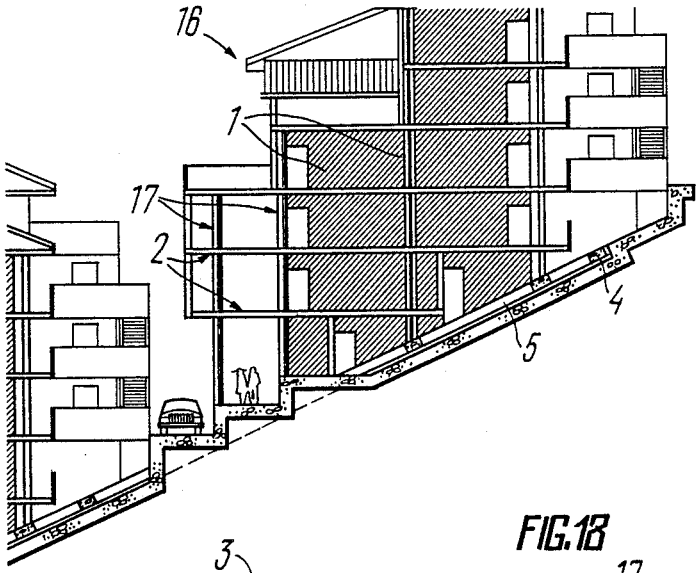
FIG. 18 is a view "A" of FIG. 16.
Figure 17:
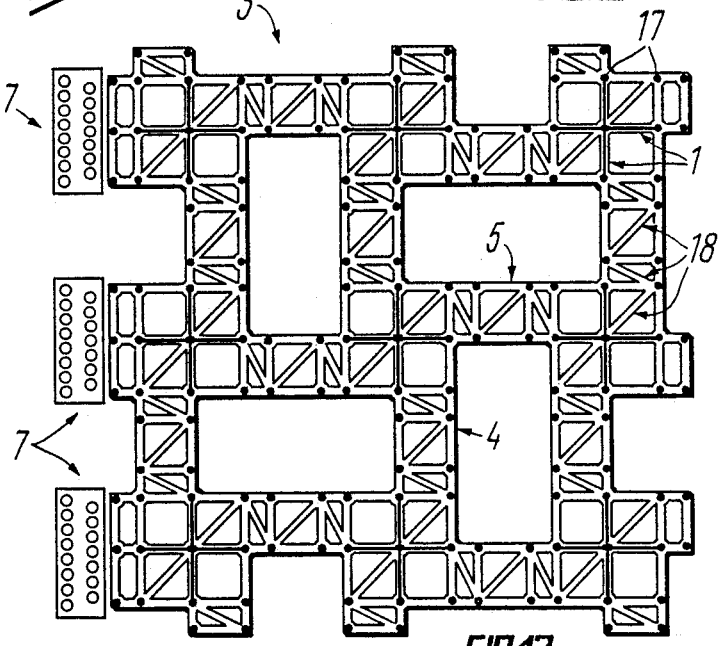
FIG. 17 is a plan view of a variant of the building structure erected on a slope.
Figure 19:
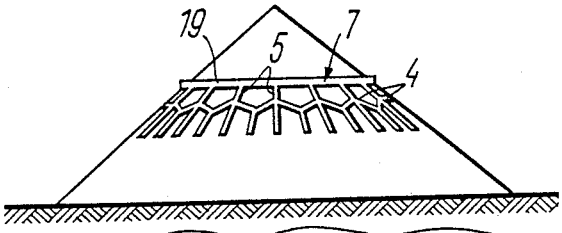
FIG. 19 is the general view of a building structure erected on the slopes of a mountain or hill.
Figure 20:
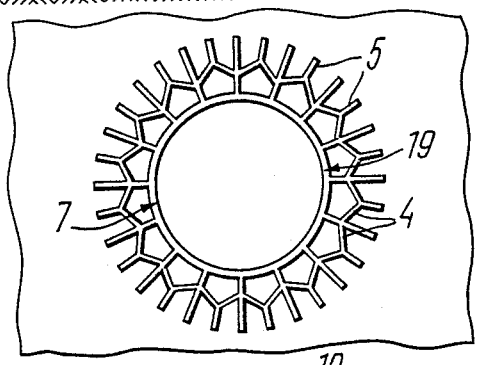
FIG. 20 is a plan view of the same.
Figure 21:
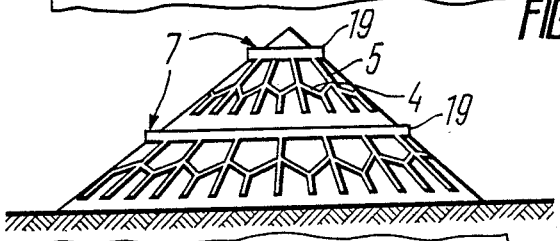
FIG. 21 is the general view of two foundations of building structures erected on the slopes of a mountain or hill.
Figure 22:
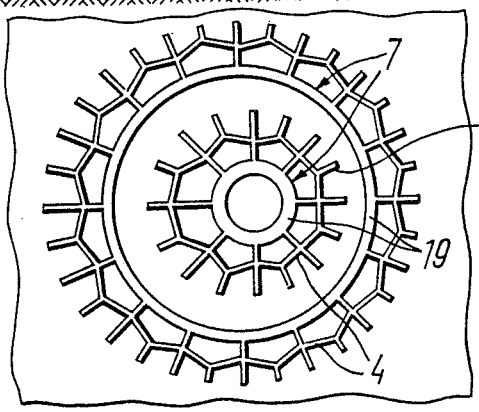
FIG. 22 is a plan view of the same.

FIGS. 12,13, 14 show a variant of the attachment of the foundation 3 on a slope.

The foundation 3 of the building in the form of a reinforced concrete grate made up of cross 5 and longitudinal 4 strips is arranged on the slope comprising soft soils 13 and primary rocks 14. The cross strips 5 are fixed on the surface of the slope laid out along the generatrix of the slope surface with the aid of pre-stressed anchors 15. The upper ends of the anchors 15 are connected to the cross strips 5 in the middle of the latter's spans, while the lower ends of the anchors 15 are secured in the primary rocks 14 of the slope mass. The anchors 15 serve as the means 7 receiving the sloping component of the external loads of the frame and the foundation 3. The building structures are erected as follows. First, lay-out operations are performed on the slope. Wells for the anchors 15 are made and the latter are fixed in the primary rock 14. Thereafter, the strips 4,5 are mounted simultaneously pre-stressing the anchors 15 on the strips 5. Then, the upper ends of the anchors 15 are connected to the strips 5. The overfoundation structures of the building are erected in the order described hereinabove.

The external load from the building weight is transmitted to the slope through the strips 4,5. The vertical force from the building weight is resolved into two components, one of which is directed along the generatrix of the slope surface and the other-normally to this surface. The sloping component of the vertical load is received by the pre-stressed anchors 15 transmitting the load to the primary rock 14. The other component is transmitted by the strips 4,5 of the foundation 3 to the slope. This component holds the soft soils 13 in a stable position together with the pressing force of the anchors 15.

The anchors 15 may be mounted by a shaft technique in the lower and upper beds of the slope.

FIGS. 15,16,17 and 18 show the building comprising individual frame systems 16 arranged in a cascade pattern on the slope, the foundation 3 in the form of a reinforced concrete grate-truss with internal free spaces and the means 7 receiving the sloping component of the external loads from the weight of the frame and the foundation 3 directed along the generatrix of the slope surface. The means 7 is made in the form of the piles 8 and the grillage 9.

The frame system 16 comprises rigid vertical elements 1, props 17 and horizontal elements 2. The elements 1 and props 17 are rigidly connected to the foundation 3. The foundation 3 is made up of cross 5, longitudinal 4 and diagonal 18 strips.

The building structures are erected as follows: first, the lay-out operations are performed on the slope and the piles 8 and grillage 9 are encased in concrete. Once the concrete of these structures has reached a design strength, the foundation strips 4,5,18 are mounted. Thereafter, the foundation structures of the frame systems 16 are erected.

The external load from the building weight is transmitted to the slope by means of the strips 4,5,18 of the foundation 3. The vertical force is resolved into two components, one of which is directed along the generatrix of the slope surface, while the other is directed normally to this surface. Via the foundation 3 the sloping component is transmitted to the structures of the grillage 9 and piles 8 owing to which the slope beneath the foundation 3 is in a stable position.

The foundation 3 transmits the normal component to the slope.

During seismic activity the vertical loads are received by the building structures in the manner analogous to that described hereinabove. The reception of horizontal seismic loads is ensured by the vertical components 1 rigidly linked with the foundation 3 which are arranged in the centre of the masses of the frame systems 16 to prevent them from turning.

FIGS. 19,20,21 and 22 show variants of the erection of a building on top of a hill.

The foundation 3 of the building is made in the form of a reinforced concrete grate of longitudinal 4 and cross 5 strips arranged on the hill slopes. A reinforced concrete ring 19 encompasses the hill and is connected to the cross strips 5 of the foundation 3. The bearing surface of the strips 5 is located along the generatrix of the hill surface. The ring 19 serves as the means 7 receiving the sloping component of the external loads of the frame and the foundation 3.

The building structures are erected as follows. First, the lay-out works are effected on the slope. The reinforced concrete ring 19 is then made from in-situ or precast concrete using preliminary tension of the reinforcement.

Once the concrete of the ring 19 has reached the design strength, the foundation strips 4 and 5 are mounted with a simultaneous attachment of the cross strips 5 to the ring 19.

The external load from the building or structure weight is transmitted to the slope by the strips 4,5 of the foundation 3, the vertical force being resolved into two components, one of which is directed along the generatrices of the slope surface and the other normally to this surface. The sloping component is transmitted through the cross strips 5 to the ring 19.

As the elements of the foundation 3 and overfoundation structures close the surface of the hill, there is formed a geometrically unchanged space system featuring higher stability to wind and seismic loads. The slope is located under the foundation 3 in a compressed state which enhances reliability of the slope-building system as a whole. In case the foundation 3 is made for a building which completely embraces the hill, the longitudinal strips 4 are connected to each other to form closed rings 19 capable of receiving tensile stresses. In this case the ring 19 is a component part of the foundation, i.e., plays the role of the foundation 3 and the means 7 receiving the sloping components of the external loads of the frame and the foundation 3.

The present invention may be employed for the development of unused or partially used areas to date, such as steep slopes at foothills, hills, ranges, ravines, hollows, the banks of rivers, lakes, the shores of seas and oceans. In these areas there may be built recreational facilities, such as sanatoria, rest-homes, holiday hotels, motels, tourist, mountain-skiing and mountain-climbing bases of the terrace and terrace-cascade type, dwelling houses of a terrace, terrace-cascade or structural type, and other structures of various designs.

We claim:

1. A building or structure erected on a surface of at least one slope, comprising:

a foundation having a base extending along the surface of the at least one slope;

a frame of vertical components and horizontal components connected to said foundation;

means provided on said foundation receiving slanting components of external loads on the frame and the foundation directed along the at least one slope, wherein the foundation is a reinforced concrete grate made up of longitudinal strips and cross strips arranged on opposite slopes of a ravine, and wherein the means receiving the slanting components of the external loads on the frame and the foundation receives the slanting components of the external load directed along each slope and forms a connection between lower ends of said cross strips.

2. A building or structure as claimed in claim 1, wherein each of the horizontal components of the frame is connected to the foundation by a hinged joint.

3. A building or structure erected on a surface of at least one slope, comprising:

a foundation having a base extending along the surface of the at least one slope;

a frame of vertical components and horizontal components connected to said foundation, the foundation connected to the frame by means of said horizontal components;

means provided on said foundation receiving slanting components of external loads on the frame and the foundation directed along the at least one slope, wherein the foundation is a reinforced concrete grate made up of longitudinal strips and cross strips arranged on opposite slopes of a ravine, the means receiving the slanting components of the external loads on the frame and the foundation being the horizontal components of the frame and interconnecting the longitudinal strips.

4. A building or structure erected on a surface of at least one slope, comprising:

a foundation having a base extending along the surface of the at least one slope;

a frame of vertical components and horizontal components connected to said foundation;

means provided on said foundation receiving slanting components of external loads on the frame and the foundation directed along the at least one slope, wherein the foundation is a reinforced concrete grate made up of longitudinal strips and cross strips arranged on opposite slopes of a mountain or hill, the means receiving the slanting components of the external loads on the frame and the foundation connecting upper ends of said cross strips.

5. A building or structure erected on a surface of at least one slope, comprising:

a foundation having a base extending along the surface of the at least one slope;

a frame of vertical components and horizontal components connected to said foundation, the foundation connected to the frame by means of said horizontal components;

means provided on said foundation receiving slanting components of external loads on the frame and the foundation directed along the at least one slope, wherein each connection between the horizontal components of the frame and the foundation is a hinged joint.

6. A building or structure erected on a surface of at least one slope, comprising:

a foundation having a base extending along the surface of the at least one slope;

a frame of vertical components and horizontal components connected to said foundation;

means provided on said foundation receiving slanting components of external loads on the frame and the foundation directed along the at least one slope, wherein the foundation is connected to the frame by the vertical components thereof, the foundation being a reinforced concrete grate-truss comprising longitudinal strips, cross strips and diagonal strips.

7. A building or structure erected on a surface of at least one slope, comprising:

a foundation having a base extending along the surface of the at least one slope;

a frame of vertical components and horizontal components connected to said foundation;

means provided on said foundation receiving slanting components of external loads on the frame and the foundation directed along the at least one slope, wherein the foundation is made in the form of a reinforced concrete grate comprising longitudinal strips and cross strips arranged on a hill forming said at least one slope, and wherein a closed ring encircling the hill and connected to the cross strips of the foundation forms the means provided on said foundation receiving the slanting components of the external loads of the frame and the foundation.

8. A building or structure as claimed in claim 7, wherein the ring is a component part of the foundation.

* * * * *